US005354127A

United States Patent [19]

Del Zotto et al.

[11] Patent Number: 5,354,127

[45] Date of Patent: Oct. 11, 1994

[54] SEGMENTED MIXING AUGER

[76] Inventors: William Del Zotto, 1601 SW. 27th Ave., Ocala, Fla. 32674; William Ackerson, Rte. 2, Sturgeon Lake, Minn. 55783

[21] Appl. No.: 185,315

[22] Filed: Jan. 21, 1994

Related U.S. Application Data

[63] Continuation of Ser. No. 815,568, Dec. 26, 1991, abandoned, which is a continuation of Ser. No. 506,778, Apr. 10, 1990, abandoned.

[51] Int. Cl.[5] ..... B28C 5/16; B28C 7/16

[52] U.S. Cl. ..... 366/27; 366/50; 366/66; 366/186; 366/298; 366/320; 366/322

[58] Field of Search ..... 366/15, 19, 20, 21, 366/27, 33, 35, 64, 38, 50, 186, 37, 290, 196, 291, 318, 319, 66, 320, 322, 323, 297, 298, 300; 198/664, 665, 617, 674, 675

[56] References Cited

U.S. PATENT DOCUMENTS

| | | | |
|---|---|---|---|
| 348,205 | 8/1886 | Haire | 366/186 |
| 566,143 | 8/1896 | Cromwell et al. | 366/186 X |
| 902,992 | 11/1908 | McEvoy | 366/319 X |
| 934,603 | 9/1909 | Gedge | 366/319 X |
| 986,553 | 3/1911 | Derby | 366/319 X |
| 1,546,336 | 7/1925 | Browne | 366/35 |
| 1,754,533 | 4/1930 | Van Kirk | 366/50 X |
| 2,104,191 | 1/1938 | Flynn | 366/291 X |
| 2,538,891 | 1/1951 | Zimmerman et al. | 366/319 X |
| 2,991,870 | 7/1961 | Griffith et al. | 366/291 X |
| 3,128,997 | 4/1964 | Young | 366/64 X |
| 3,153,494 | 10/1964 | Heider | 222/144.5 X |
| 3,186,602 | 6/1965 | Ricciardi | 366/320 X |
| 3,348,820 | 10/1967 | Wilkinson et al. | 366/64 |
| 3,387,829 | 6/1968 | Nangoh et al. | 366/64 X |
| 3,430,924 | 3/1969 | Hosokawa et al. | 366/318 X |
| 3,469,824 | 9/1969 | Futty et al. | 366/64 |
| 3,871,628 | 3/1975 | Pulk et al. | 366/35 X |
| 3,885,774 | 5/1975 | Harris et al. | 366/20 |
| 3,921,962 | 11/1975 | Feger et al. | 366/64 |
| 3,942,768 | 3/1976 | Hughes | 366/318 X |
| 4,298,288 | 11/1981 | Weisbrod | 366/20 X |
| 4,403,864 | 9/1983 | Stastny | 366/50 X |
| 4,483,625 | 11/1984 | Fisher | 366/196 X |
| 4,551,024 | 11/1985 | Clapp | 366/64 X |
| 4,579,459 | 4/1986 | Zimmerman | 366/27 |
| 4,624,575 | 11/1986 | Lantz | 366/20 X |
| 4,768,884 | 9/1988 | Elkin | 366/50 X |
| 4,783,171 | 11/1988 | Zimmerman | 366/50 X |
| 4,922,463 | 5/1990 | Del Zotto et al. | 366/21 |

FOREIGN PATENT DOCUMENTS

| | | | |
|---|---|---|---|
| 1236386 | 3/1967 | Fed. Rep. of Germany | 366/64 |
| 3347417 | 7/1985 | Fed. Rep. of Germany | 366/20 |
| 512843 | 10/1920 | France | 366/196 |
| 2264640 | 10/1975 | France | 366/50 |
| 2380066 | 9/1978 | France | 366/64 |
| 2090761 | 7/1982 | United Kingdom | 366/20 |
| 2126491 | 3/1984 | United Kingdom | 366/66 |

*Primary Examiner*—David A. Scherbel
*Assistant Examiner*—Charles Cooley
*Attorney, Agent, or Firm*—Douglas L. Tschida

[57] ABSTRACT

An auger conveyor assembly including a helical auger infeed section having interrupted auger flights which communicate with an offset, commonly driven outfeed section including a helical ribbon auger and whereat both augers simultaneously blend the mixture at a controlled speed differential. A surrounding housing includes a formed length of rubberized channelway and means are provided for varying the tilt angle of the housing, whereby the blending rate and contained volume of mixture are controlled relative to an outlet port.

9 Claims, 6 Drawing Sheets

SEGMENTED MIXING AUGER

This is a continuation of application Ser. No. 07/815,568, filed Dec. 26, 1991 now abandoned, which is a continuation of application Ser. No. 07/506,778 filed Apr. 10, 1990 now abandoned.

BACKGROUND OF THE INVENTION

The present invention relates to cement mixing equipment and, in particular, to a conveyer auger for blending mixture components over the length of the augerway, prior to the concrete exiting an outlet port.

Varieties of cement mixers have been developed over the years to accommodate the needs of various users. Such mixers range in size from small trailerable, pot-like units having a motor driven revolving drum, which are hand fed with mixture components, to multi-story assemblies which are fully automatic.

One mixer type within this broad range and relative to which the present invention is particularly directed are mixers which are used by pre-casters for manufacturing stairs, septic tanks and the like. Such mixers are sized to mix approximately 20 yards before re-filling of the aggregate mixture bins and may only mix on the order of 100 yards of concrete over the course of a typical day. The concrete is particularly prepared on a semi-continuous or batch basis as forms are stripped and readied to receive the concrete.

To meet the needs of this class of users, Applicants have developed a mixer which is marketed as a model WDZ-200 Such mixers generally provide a multi-compartmented housing whereat sufficient quantities of gravel, sand and cement are contained and automatically fed under operator control in relatively precise volumes. A bulk cement storage silo can also be attached to the mixer.

The mixture components are otherwise metered via a unitary drive train and deposited through controlled apertures at the infeed end of a related blending auger which mounts to the forward end of the housing. More of the details of this mixer can be found upon directing attention to Applicant's related promotional literature or U.S. Pat. No. 4,922,463, filed Aug. 22, 1988 and entitled Portable Volumetric Concret Mixer/Silo.

From such materials, it is to be noted that Applicant has previously used a fixed length, spiral fluted auger assembly to effect blending of the mixture components over the length of travel of the auger. Blending cycle time has been controlled relative to a constant, fixed RPM drive speed by controlling the relative angle of the auger assembly to the mixer via an associated boom control. Constant uniform blending and conveyance of the concrete is, in turn, effected via rotation of the solid bodied auger flutes.

Depending upon the intended use of the concrete and the nature of the mixture components, Applicant has however discovered that sufficient agitation and blending may not always occur over the length of the relatively short augerway. Although a longer augerway or a variable drive might be substituted. A longer augerway and/or a variable speed auger drive, also significantly add to the cost of the mixer.

A need therefore exists for a new type of auger assembly which provides a stepped or segmented agitation of the mixture over the length of the auger, without resort to a variable motor drive and which further permits a suitable range of blending cycle times to effect optimal mixing.

Relative to various concrete mixing assemblies of which Applicants are familiar and which include fluted conveyer augers, assemblies are disclosed in U.S. Pat. Nos. 3,153,494; 4,298,288; and 4,624,575. Within each of these patents, helical, full-webbed augers are disclosed which are principally used to convey selected materials over the length of various mixer assemblies.

Applicants are also aware of British Patent No. 2,090,761 which discloses a two-stage, high speed, shear mixer. A first stage particularly includes a ribbon portion a plurality of paddle portions and a ribbon portion which serially convey a cement slurry to a second stage which includes a plurality of paddles. The stages otherwise are contained within a fully enclosed housing and are intended to operate at high rates of revolution, with relatively short path lengths, to mix grouts, plasters, gypsum and other nonaggregate containing mixtures. Material transfer occurs by way of a shear action that is created between the ends of the augers and the housing walls. In contrast, the augerway of the present invention is intended to mix and transfer concrete or other materials including relatively large concentrations of coarse aggregates by way of the auger flights.

SUMMARY OF THE INVENTION

It is accordingly a primary object of the present invention to provide a concrete mixer, auger assembly for blending and conveying the relatively high volume aggregate mixtures with segmented or zoned agitation of the mixture over various portions of the augerway.

It is a further object of the invention to provide an augerway which is adaptable to a variety of mixers, either on a factory installed basis or on an after-market basis.

It is a further object of the invention to provide a plurality of parallel augerways including overlapping zones of agitation over the length of the augerway.

It is a still further object of the invention to provide an augerway including an offset dump section of a different drive ratio than the remainder of the augerway.

Various of the foregoing objects, advantages and distinctions of the invention are particularly achieved in a presently preferred construction which provides for an elongated, multi-sectioned augerway housing. The housing includes a number of hinged access covers and the bottom is substantially formed of a rubberized belting shaped about the augers.

An infeed end-mounted constant speed drive assembly; including a drive motor, right angled gear drive and chain coupler, provides a direct drive link to a primary, multi-flighted spiral formed auger. Selected ones or portions of the flights of the primary auger are deleted to provide a beating action at various positions over the length of the primary auger.

An outfeed end-mounted, geared drive coupler secured to the primary auger independently drives a second spiral, ribbon auger at an increased rate at a dump housing portion of the augerway. Material transfer rates relative to an outlet port in the dump housing are varied, in part, via adjustment of the augerway inclination.

Still other objects, advantages and distinctions of the invention will become more apparent hereinafter upon reference to the following detailed description with respect to the appended drawings. Before referring thereto, it is to be appreciated that the description should not be interpreted in limitation of the spirit and scope of the invention. Rather, it should be interpreted to include all those equivalent embodiments within the scope of the following claims. To the extent that modifications or alternative constructions have been considered, they are described as appropriate.

DESCRIPTION OF THE PREFERRED EMBODIMENT

Figure 1:
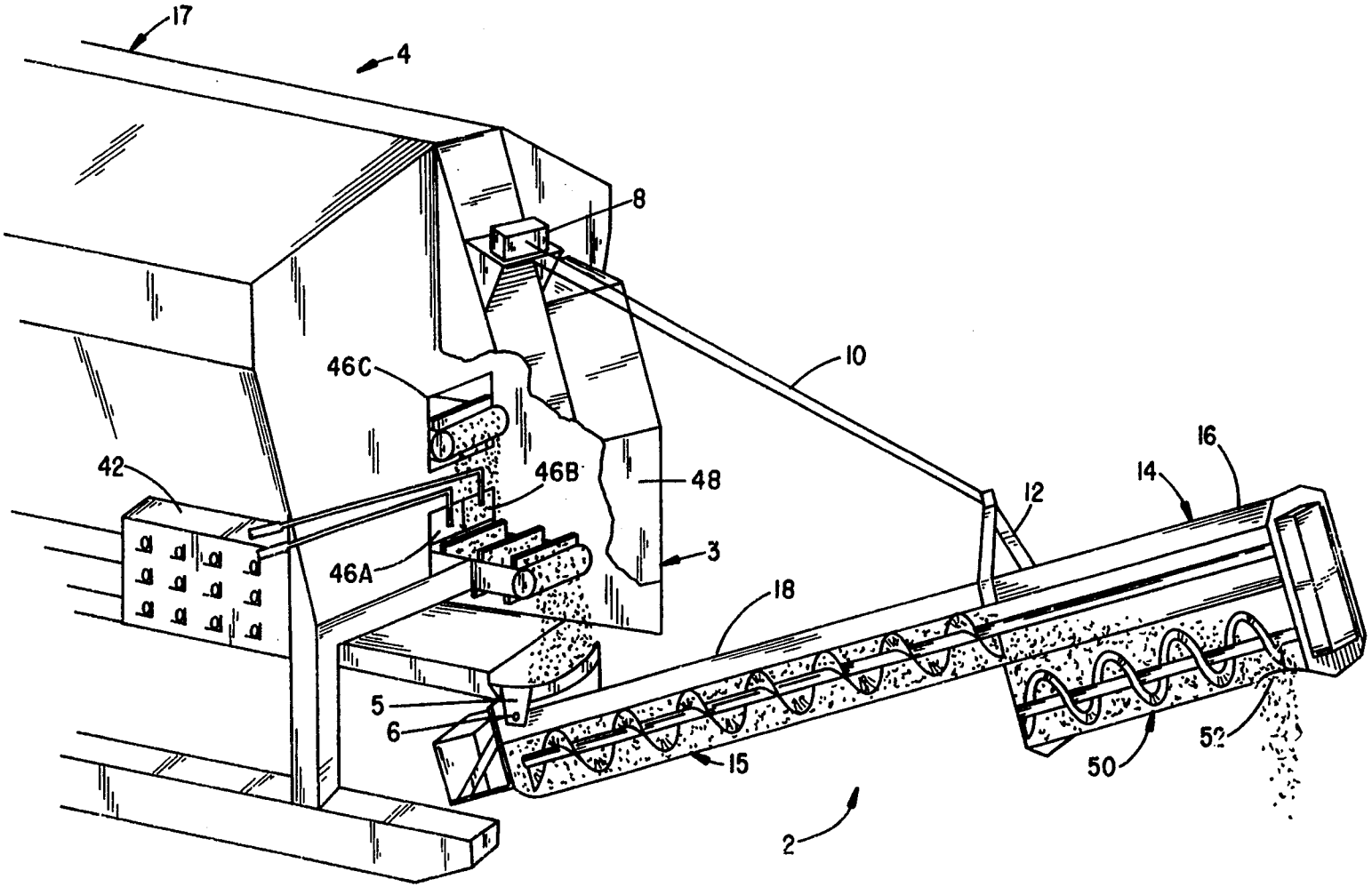
FIG. 1 shows an isometric drawing of the presently improved auger assembly in mounted relation to the fore-end a typical mixer housing.

Referring to FIG. 1, an isometric drawing is shown of the improved blending auger 2 of the present invention in mounted relation to a typical mixer 4. That is, the auger assembly 2 is pivotally secured to the outfeed portion 3 of a typical mixer at a pair of pivot pins 6 only one of which is shown, and which mate with flange arms 5 that extend from the mixer 4 or alternatively the auger 2.

An overlying and operator controlled winch assembly 8 and cable 10 is secured to a support bracket 12 which projects from a forward or dump end of the auger housing 14. The bracket 12 particularly projects from a space between fore and aft hinged covers 16 and 18, both of which are shown in their closed condition.

While the blending time of the concrete within the auger assembly 2 can be varied by adjusting the feed rate from the mixer 4 or by adjusting the speed or the inclination of the auger assembly 2, Applicant has opted to provide a fixed speed drive. This is due, in part to the greater costs of variable speed, feed or mixing rate assemblies, whether at the mixer 4 or the auger 2. The construction of the auger assembly 2, however, then becomes more critical.

Although, too, Applicants' predecessor mixer provided adequate concrete mixtures, some deficiencies were encountered in the obtained blends for certain applications. Some deficiencies were due to an abbreviated blend time. Such deficiencies have, however, been substantially overcome with the presently improved design which provides for an extended range of blend times and an improved mixing action. The reasons for these improvements will be discussed in greater detail below.

While, too, the present auger assembly 2 is shown in FIG. 1 in mounted relation to Applicants' model WDZ-200 mixer, mixers of other manufactures can also be fitted with the auger 2. The particular mounting can either be to a vertical pivot assembly, as in FIG. 1, or alternatively to a rotatable, turntable assembly 20 as in FIG. 5. For the assembly 20, the pivot pins 6 mount to flange arms 21 which extend from the bearing supported turntable 22. One of the bearings 23 is shown in the cutaway portion of the turntable 22. Multiple pivot apertures 25 may also be provided at the auger to accommodate mounting to the mixer 4. Relative to the mixer 4 and without discussing it in detail, it is to be appreciated that it includes a housing 17 which contains multiple bins wherefrom quantities of sand, aggregate and cement or other mixture components are metered under operator control. The components are conveyed from the bins and rough mix with each other as they emerge from outlet ports displaced above the infeed end to the auger 2. Water is added at the infeed end of the auger 2 and final blending occurs over the length of the auger 2. Proper blending must therefore occur over the relatively short length (i.e. twelve feet) of the auger 2 to provide precast structures which will not fail due to mixture deficiencies. For example, "dry spots" in the mix, where adequate wetting did not occur. Additional details and discussion of the mixer 4 can be found in Applicant's above mentioned U.S. Pat. No. 4,922,463.

Figure 2:
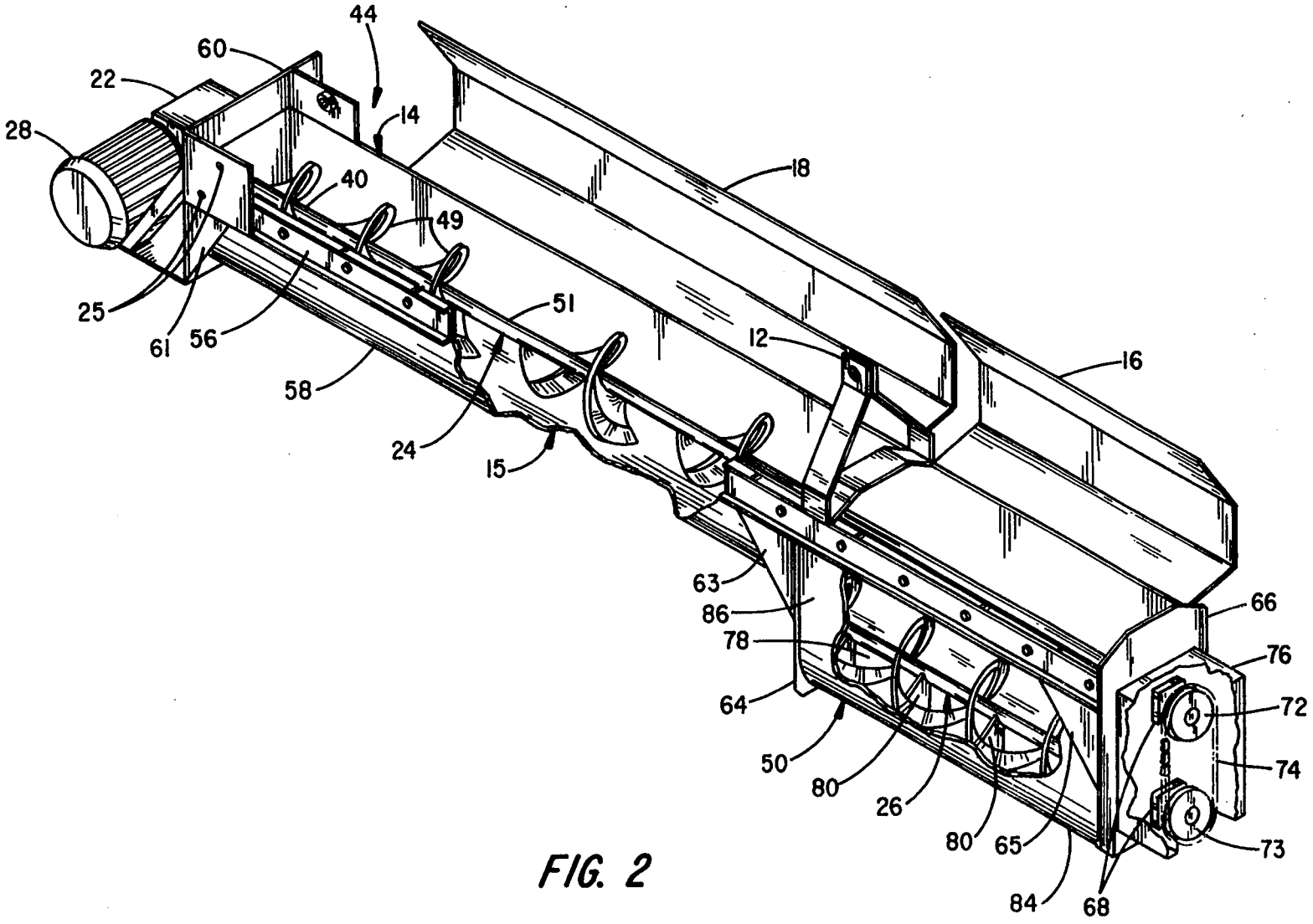
FIG. 2 shows an isometric drawing in partial cutaway of the present auger.
Figure 3:
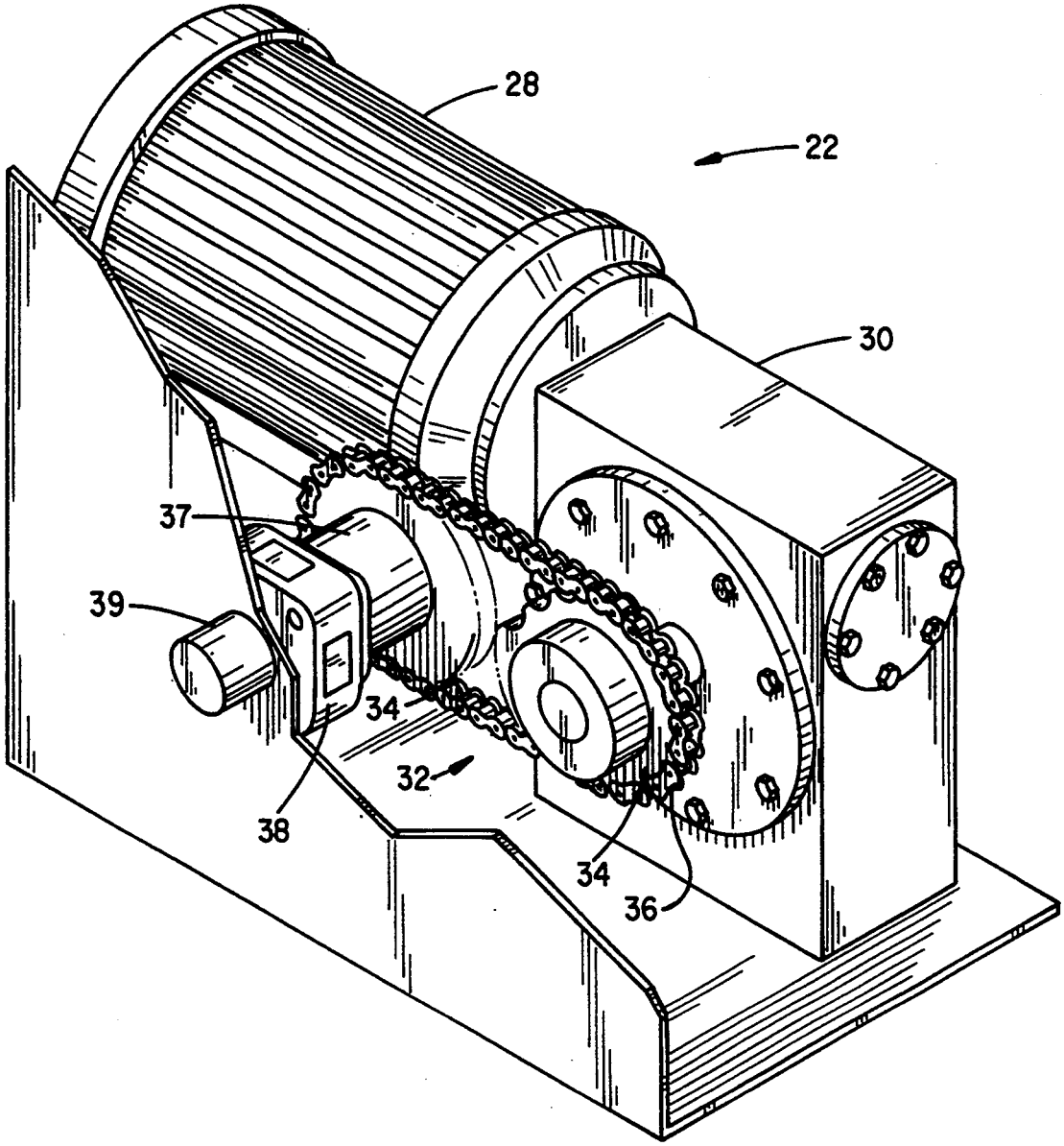
FIG. 3 shows a detailed isometric drawing of the constant speed driver assembly.
Figure 4:
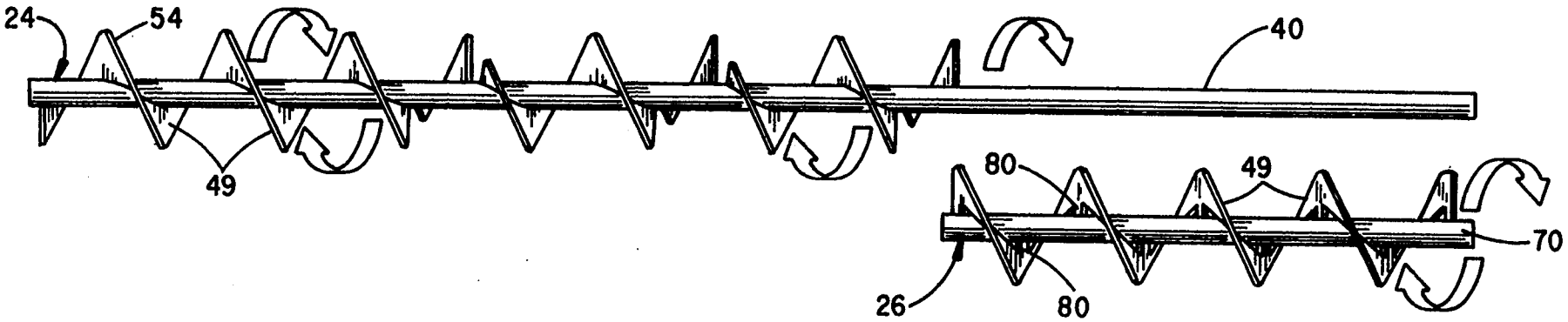
FIG. 4 shows an elevation view of the primary and dump augers in removed relation to each other.

Turning further attention to FIGS. 2, 3 and 4 and the details of the auger assembly 2, it is principally comprised of a motorized drive section 22, the housing 14 and a parallel mounted primary auger portion 24 and dump auger 26 which are aligned along a common longitudinal axis. The drive section 22, which is shown in detail in FIG. 3, includes a drive motor 28, a right angled gear reduction assembly 30 and a chain coupler assembly 32. The coupler 32, in turn includes a pair of sprockets 34, chain 36, a bearing 37, seal 38 and output shaft 39 which connects to the center shaft 40 of the primary auger 24. Appropriate drive control signals are coupled to the motor 28, nominally 10 horsepower, via the mixer control panel 42. As presently constructed, a limited slip gear reduction assembly 30 is used to prevent damage to the auger portions 24, 26, in the event of blockage or jamming which might occur should large chunks of frozen sand or aggregate obstruct movement of the auger assembly 2, during blending. Otherwise the primary auger portion 24 is driven at a constant speed in the range of 80–100 RPM.

Immediately forward of the drive section 22 at a shortened end of the cover 18 and exposing the interior of housing 14 is an infeed port 44 to the primary auger 24. The port 44 is shrouded with appropriate rubber and/or metal formed shroud members (not shown) which fit to the mixer 4 to minimize dust buildup or other undesired accumulations which might otherwise occur as the sand, aggregate, and water are first introduced to the auger.

The primary auger 24 thus receives mixture components which partially mix as they fall from overlying mixer outlet ports **46*a*, 46*b*, and 46*c*, normally hidden beneath safety covers 48, and the rotative action of the primary spiral auger flights 49 carries the ingredients forward to blend the ingredients as they are conveyed. After transversing approximately eight feet of the twelve foot auger 2, which corresponds to a first section 15 of the housing 14 a forward second section or dump portion 50 of the housing 14 is attained and whereat the blended mixture is further agitated via at least one offset, secondary or dump auger portion 26. Other than apparent differences in construction, the auger portion 26 is operated at a higher speed from that of the primary auger portion 24. That is, the dump auger 26** is typically set to rotate in the range of 105–160 RPM. The reasons for this and manner of achieving same will be discussed below.

As depicted in the auger assembly of FIGS. 1 through 5, the flights 49 of the primary auger 24 are removed from within the forward, dump section 50.

Figure 6:
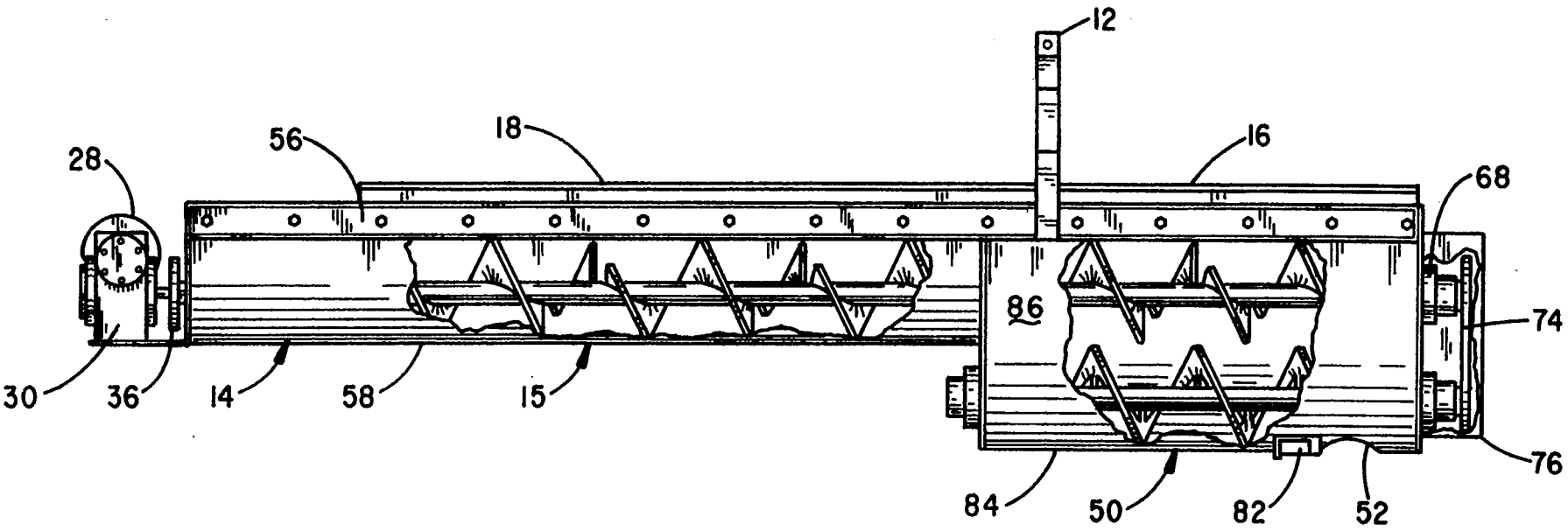
FIG. 6 shows an elevation view in partial cutaway of an alternative auger assembly which includes with primary auger flights at the dump section.

Such flights might however be included, such as in fashion of FIG. 6. Regardless, though, the mixture is further blended within the dump section 50 prior to exiting from an outlet port 52 at the most forward end of the auger assembly 2. There the mixture is received via wheelbarrows, carts or other conveyers or transport mechanisms (not shown) which deliver the cement to the pour site. Such assemblies however do not comprise a part of the present invention.

The details of the auger assembly 2 are particularly apparent in FIGS. 2 and 4 which respectively show an isometric view in cutaway and the primary and dump augers 24 and 26 removed form the assembly 14. Turning attention, first, to the primary feed auger 24, it comprises a center shaft 40 and about which helically extend a plurality of full height, spiral formed auger blades or flights 49. Each flight comprises a complete 360 degree rotation of the composite block 54.

In lieu of a continuous length spiral blade 54, flight sections after the first one or two sections are intermittently removed to produce gaps 51, approximately every two feet, from the auger portion 24 to induce delays and a beating action into the blending/transfer of the concrete. That is, by deleting all or a portion of the flights 49 such as one-half or 180 degrees of a 360 degree section, the conveyance of the material is interrupted. Materials back up at each interruption, assuming as constant auger speed, which permits a re-blending of the mixture and a beating action as the blunt edges of the flights 49 strike the mixtures, prior to the continued conveyance of the mixture.

By judicially deleting flights 49, such as at the gaps 51, an improved agitation is achieved, which is especially critical for a relatively short length auger, such as with the present assembly 2.

Figure 5:
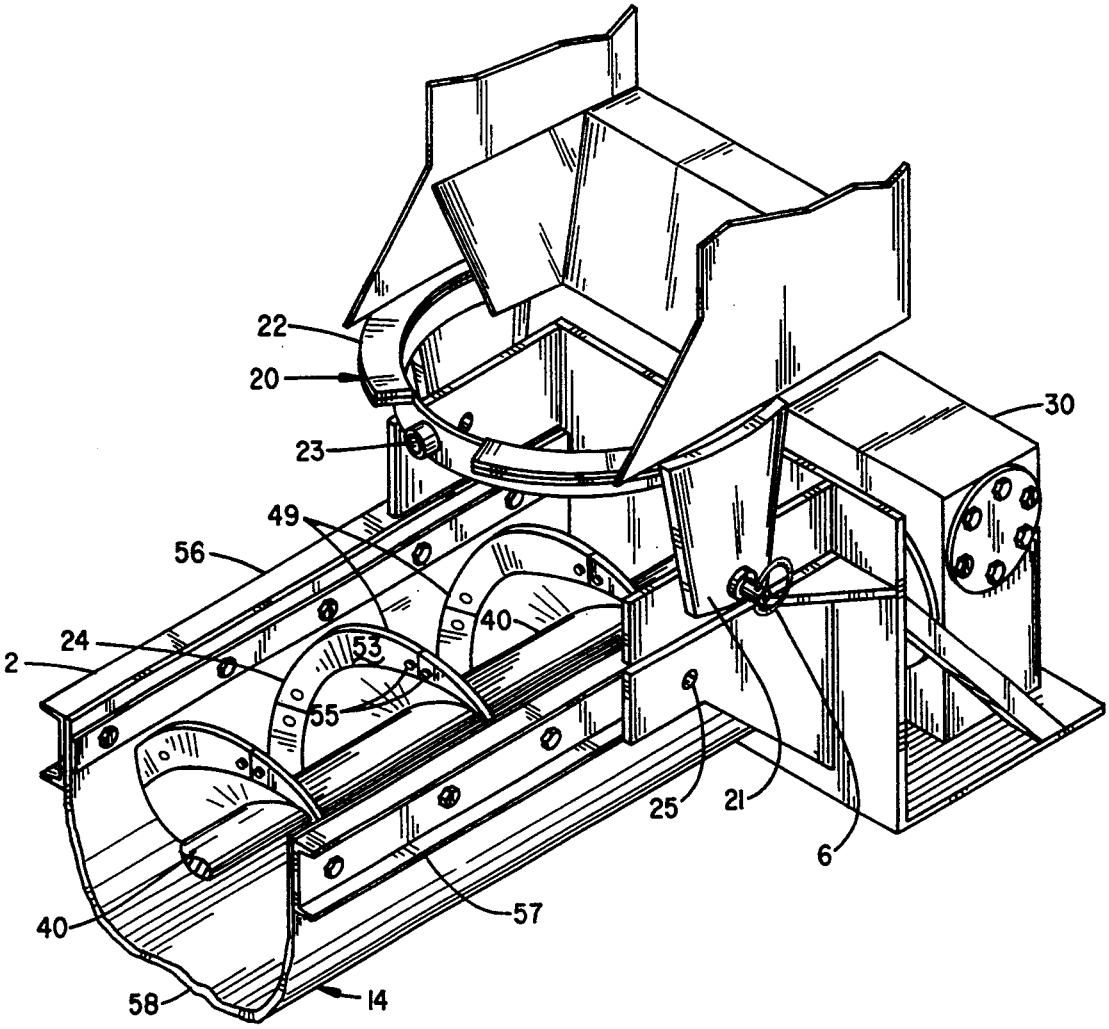
FIG. 5 shows an isometric view of a turntable mounted auger assembly.

Secured to the outer peripheral, leading edge of each flight 49 are a plurality of Ni-hard guard plates 53 (reference FIG. 5). Approximately four of these guards plates 53 are secured with rivets 55 or other suitable fasteners to each 360 degree flight 49 of the auger portions 24 and 26 to resist abrasion and wear, which otherwise occurs within the cement mixing environment wherein the invention finds particular application.

Surrounding the auger portions 24 and 26 and supporting the extreme ends of the center support shaft 40, which typically comprises a length of two inch tubular rod stock, is the housing 14. The housing 14 contains the cement mixture as it is blended and conveyed from the input port 44 to the forward outlet port 52. The housing 14 is generally constructed of a pair of rigid lengths of channel stock or rails 56 and 57 and between which an arcuately formed rubber belting member 58 is secured. The U-shaped end of the belting adjacent the drive section 22 is secured to an end support plate 60 and a pair of laterally disposed gussets 61 (only one of which is shown), which further supports the seal 38 and a roller bearing 37 coupled to the end of the auger shaft 40.

The opposite end of the belting is secured to a second vertical mid-plate 64, which also supports one edge of a second length of a belting 84 which forms the dump section 50. The second length of belting is of a slightly wider dimension and extends from the opposite side plate 64 to a forwardmost end plate 66. An unsheltered aperture formed in the bottom of the forward end of the belting forms the outlet port 52.

It is at the dump section 50 that the dump auger 26 is mounted in offset, parallel relation to the primary auger 24. The shaft 70 of the dump auger 26 is secured from the vertical mid and end plates 64, 66 at a sealed bearing 68. A similar bearing 68 supports the auger shaft 40. Sprockets 72, 73 secured to the outer ends of each of the auger shafts 40, 70 are coupled to one another via a suitable chain 74, which is positioned beneath a safety cover 76.

The gear ratio between the end sprockets 72, 73 is selected such that the dump auger 26 rotates at a higher speed than the primary auger 24. Moreover, the dump auger 26 is constructed in the form of a ribbon auger. That is, the portion of each auger flight normally projecting between the shaft and the outer periphery is substantially removed to provide a longitudinal gap 78 over the length of the auger 26. Intermittent supports 80 otherwise extend from the shaft 70 to the outer edge of the Ni-hard guard covered auger flights.

Only a minimal conveying action is thereby obtained from the dump auger 26. Rather, the dump auger 26 rotates to provide a final blending of the water into the aggregate/cement mixture prior to exiting the outlet port 52. The higher speed and the greater volumetric size of the dump section 50 particularly enhances this blending and final mixing of the cement prior to leaving the housing 14.

Although the end most flights of the primary auger 24 in the region of the dump section 50 are omitted for the construction of FIGS. 1 to 5, the flights might be included in the fashion of FIG. 6 to assure a complete blending of the mixture within the dump section from top to bottom of the section. That is, if a ribbon auger only is used, a tendency exists for the mixture to stratify about the auger 26. By including conveyer flights at the primary auger 24, the mixture, as it rises, is recirculated or folded into the mixture surrounding the dump auger 26 to assure complete blending. For the embodiment of FIG. 6, a shutter 82 has been provided on the bottom of the housing 14 to control the size of the outlet port 52. The shutter can provide advantages, depending upon the inclination of the auger assembly 2.

In passing, it is also to be noted at FIG. 6 that the triangular pairs of gussets 61, 63 and 65 normally provided to support each of the plates 60, 64 and 66 have been deleted. Instead, a full length, arcuate, metal-formed bottom 84 is provided at the dump section 50. The bottom 84 extends upward approximately mid-height between the plates 64, 66. A section of belting 86 otherwise extends between the bottom 84 and the rails 56 and 57.

While the present invention has been described with respect to its presently preferred constructions and various considered modifications which might be made thereto, it is to be appreciated that still other modifications might suggest themselves to those of skill in the art. Accordingly, it is contemplated that the following claims should be interpreted to include all those equivalent embodiments within the spirit and scope thereof.

We claim:

1. Conveyor apparatus comprising:

a) a housing including bottom, side and end walls, wherein said walls define a single, uninterrupted mixing cavity having first and second continuous sections, wherein said first section extends from a first end wall to a region of said cavity where a second end wall depends from a bottom wall of said first section, wherein said second section extends from said first section and between said second end wall and a third end wall, and wherein a bottom wall of said second section includes an outlet port, and further including a plurality of hinged covers which mount over said first and second sections, except in the region of an inlet port where a charge of mixture components is received;

b) a first auger mounted to extend between said first and third end walls and including a first shaft and a first web, wherein said first web helically projects from said first shaft, wherein said first web includes a plurality of voids intermittently spaced along the length of said first shaft and one of which voids spans said second section;

c) a second auger mounted beneath and parallel to said first auger to extend between said second and third end walls and including a second shaft and a second web, wherein said second web helically projects from said second shaft;

d) drive means for rotatively driving said first auger; and e) coupling means mounted to said third end wall for coupling said first auger to said second auger such that said second auger rotates at a different rate of rotation than said first auger and whereby the charge of mixture components are blended by both of said first and second augers.

2. Apparatus as set forth in claim 1 wherein a plurality of edge portions of said second web are spaced apart from the second shaft over the length of said second auger.

3. Apparatus as set forth in claim 1 wherein said first auger rotates in a range of 80 to 100 revolutions per minute and said second auger rotates in a range of 105 to 160 revolutions per minute.

4. Apparatus as set forth in claim 1 including a plurality of hardened plates and wherein a leading surface of each of said first and second webs is faced with at least one of said plates.

5. Apparatus as set forth in claim 1 wherein said housing includes means for pivotally coupling one end of said housing to dispensing means for dispensing the charge of mixture components into said inlet port and further including means depending between said housing and dispensing means for controlling the inclination of said housing relative to said dispensing means.

6. Conveyor apparatus comprising:

a) a housing including bottom, side and end walls wherein said walls define a single, uninterrupted mixing cavity having first and second continuous sections, wherein said first section extends from a first end wall to a region of said cavity where a second end wall depends from a bottom wall of said first section, wherein said second section extends from said first section and between said second end wall and a third end wall, and wherein a bottom wall of said second section includes an outlet port, and further including a plurality of hinged covers which mount over said first and second sections, except in the region of an inlet port where a charge of mixture components is received;

b) a first auger mounted to extend between said first and third end walls and including a first shaft and a first web, wherein said first web helically projects from said first shaft, and wherein said first web is comprised of a plurality of flight sections, each of said flight sections being of substantially 180 degrees revolution and each being faced with a hardened plate member;

c) a second auger mounted beneath and parallel to said first auger to extend between said second and third end walls and including a second shaft and a second web, wherein said second web helically projects from said second shaft;

d) drive means mounted to said first end wall for rotatively driving said first shaft; and e) first and second sprockets mounted to said third end wall and respectively coupled to said first and second shafts and having a chain coupled therebetween for rotating said first and second augers at different rates.

7. Apparatus as set forth in claim 6 wherein said first web includes a plurality of voids.

8. Apparatus as set forth in claim 7 wherein ones of said plurality of voids occur within the first section and wherein said outlet port is positioned adjacent the third end wall.

9. Apparatus as set forth in claim 7 wherein one of said plurality of voids spans said second section.

* * * * *